US006081685A

United States Patent [19]

Umetani et al.

[11] Patent Number: 6,081,685

[45] Date of Patent: Jun. 27, 2000

[54] TRANSFER APPARATUS HAVING A TRANSFER DRUM

[75] Inventors: Yoshinobu Umetani, Yamatotakada; Hideki Ohnishi, Chiba; Yukikazu Kamei, Ichihara; Kiyoshi Toizumi; Kouichi Yamauchi, both of Yamatokoriyama; Fumio Shimazu, Nara, all of Japan

[73] Assignee: Sharp Kabushiki Kaisha, Osaka, Japan

[21] Appl. No.: 09/226,611

[22] Filed: Jan. 7, 1999

[30] Foreign Application Priority Data

Jan. 7, 1998 [JP] Japan ..... 10-001515

[51] Int. Cl.[7] ..... G03G 15/16

[52] U.S. Cl. ..... 399/303; 399/313

[58] Field of Search ..... 399/303, 304, 399/312, 313, 302, 308; 430/126

[56] References Cited

U.S. PATENT DOCUMENTS

| | | | |
|---|---|---|---|
| 5,390,012 | 2/1995 | Miyashiro et al. | 399/303 |
| 5,771,430 | 6/1998 | Iwakura | 399/303 |
| 5,878,314 | 3/1999 | Takaya et al. | 399/302 |

FOREIGN PATENT DOCUMENTS

| | | |
|---|---|---|
| 4-278978 | 10/1992 | Japan . |
| 4-335683 | 11/1992 | Japan . |
| 5-173435 | 7/1993 | Japan . |
| 9-212002 | 8/1997 | Japan . |

*Primary Examiner*—Sophia S. Chen
*Attorney, Agent, or Firm*—Birch, Stewart, Kolasch & Birch, LLP

[57] ABSTRACT

The object of the invention is to provide a transfer apparatus including a transfer drum which carries a transfer material by electrostatic attraction with reliability, and can prevent the transfer nonuniformity of the image. The transfer drum is so formed that on the surface of a dielectric layer made of cylinder-shaped aluminium, are formed side by side two semiconductor layers each formed by a foamed elastic member, and on the surface of the semiconductor layers are stacked a conductive layer formed by PVDF. The first semiconductor layer is formed under the transfer region within the surface of the transfer drum, and the diameter of cell is set to be in a range of over 0 $\mu$m to 50 $\mu$m. Also, the second semiconductor layer is formed under the non-transfer region within the surface of the transfer drum, and the diameter of cell is set to a size of 500 $\mu$m or more.

16 Claims, 6 Drawing Sheets

TRANSFER APPARATUS HAVING A TRANSFER DRUM

BACKGROUND OF THE INVENTION

1. Field of the Invention

The present invention relates to a transfer apparatus which includes a transfer material carrying member composed of a carrying member frame, a semiconductor layer stacked on a surface of the carrying member frame, and a conductive (dielectric) layer covering the semiconductor layer, and transfers a toner image formed on an image carrier to a transfer material carried on the transfer material carrying member by electrostatic attraction. Specifically, the invention relates to a transfer apparatus for use in a color image forming apparatus such as laser printers, copying machines, and laser faxes.

2. Description of the Related Art

With conventional color image forming apparatuses, a plurality of toner images of respective colors are formed on an image carrier composed of a photoreceptor, and the toner images of respective colors are transferred in a superposed relation onto a single transfer material, whereby a full-color image is formed.

A transfer apparatus for use in the color image forming apparatuses as described above is disclosed in Japanese Unexamined Patent Publication JP-A 5-173435. The transfer apparatus includes a transfer material carrying member composed of a carrying member frame, an elastic layer such as urethane foam covering the carrying member frame, and a conductive layer such as PVDF (polyvinylidene fluoride) covering the elastic layer. This results in the formation of a gap of 10 $\mu$m or more between the surface of the elastic layer and the underside of the conductive layer. With the transfer apparatus, the transfer material carrying member is caused to carry a transfer material by electrostatic attraction, and the transfer material carrying member is applied with a voltage of an opposite polarity to that of a toner. Thus, toner images of respective colors are successively transferred in a superposed relation to the carried transfer material.

Also in Japanese Unexamined Patent Publications JP-A 4-278978 and JP-A 4-335683, there are disclosed image forming apparatuses characterized by their respective transfer apparatuses. Each of the transfer rollers which the respective transfer apparatuses in the image forming apparatuses in both the publications have is so constructed that a foamed material with a predetermined thickness which has a conductivity is disposed around the transfer roller shaft. In the direction of the thickness of the foamed material of the image forming apparatus in JP-A 4-278978, at the closer position the cells are present to the contact surface between the foamed material and the transfer roller shaft, and the outer surface of the foamed material, the more they increase in size or number. Also, in the direction of the thickness of the foamed material of the image forming apparatus in JP-A 4-335683, at the closer position cells are present to the outer surface of the foamed material, the more they increase in size.

With the transfer apparatuses in the three publications, in the case where carrying of a transfer material onto the conductive layer by electrostatic attraction is given priority, it is required to increase the gap in size. When the gap is increased in size, there arises a problem as follows: that is, in a transfer area for transferring toner to the transfer material, within the outer surface of the conductive layer and the outer surface of the foamed material, the amount of toner transferred by the gap portion is different from the amount of toner transferred by the gap-free portion, and hence the formed image results in the image having mottles, i.e., transfer nonuniformity.

Further, resin sheets such as OHP sheets used as transfer material does not tear easily as compared with paper. Accordingly, it is required to increase the gap in size to such a size as to entail a problem in image quality for carrying such a resin sheet by electrostatic attraction with reliability.

Also, in the case where the gap is decreased in size for giving priority to image quality, the performances of carrying the transfer material by electrostatic attraction becomes insufficient, especially, the attraction force at high temperatures and high humidities is reduced. For example, there occurs a problem that when a plurality of toners of respective colors are transferred at the time of forming a color image, the transfer material is peeled off during transfer.

SUMMARY OF THE INVENTION

An object of the invention is to provide a transfer apparatus capable of improving the carrying of a transfer material by electrostatic attraction and the image quality at the same time by forming a foamed material constituting a semiconductor layer so that cells or gaps thereof have different diameters in non-transfer and transfer regions in a transfer material carrying portion of a transfer material carrier.

In a first aspect of the invention there is provided a transfer apparatus for transferring a toner image from an image carrier on a surface of which the toner image is formed, to a transfer material, the transfer apparatus comprising:

a transfer material carrier, composed of a transfer material carrying member which is composed of a carrying member frame, a semiconductor layer stacked on a surface of the carrying member frame, and a dielectric layer covering the semiconductor layer, for carrying the transfer material on a predetermined carrying portion of a surface of the dielectric layer by electrostatic attraction, wherein the semiconductor layer is formed of a foamed material, and a diameter of cell of a portion of the foamed material under a predetermined non-transfer region which is not involved in transfer of the toner image in the carrying portion is set to be larger than a diameter of cell of the foamed material in a portion under a predetermined transfer region which can be involved in transfer of the toner image in the carrying portion.

In a second aspect there is provided a transfer apparatus for transferring a toner image from an image carrier on a surface of which the toner image is formed, to a transfer material, the transfer apparatus comprising:the transfer apparatus comprising:

a transfer material carrier, composed of a transfer material carrying member which is composed of a carrying member frame, a semiconductor layer stacked on a surface of the carrying member frame, and a dielectric layer covering the semiconductor layer, for carrying the transfer material on a predetermined carrying portion of a surface of the dielectric layer by electrostatic attraction, wherein one or more gap portions are formed between the semiconductor layer and the dielectric layer, and a size of the gap portion under a predetermined non-transfer region in the carrying portion which region is not involved in transfer of the toner image is larger than a size of the gap portion under a predetermined transfer region in the carrying portion which region can be involved in transfer of the toner image.

In a third aspect of the invention it is preferable that the diameter of cell of the portion of the foamed material under the non-transfer region is 100 μm or more, while the diameter of cell of the portion of the foamed material under the transfer region is more than 0 μm and less than 100 μm.

In a fourth aspect of the invention it is preferable that the diameter of cell of the portion of the foamed material under the non-transfer region is 500 μm or more, while the diameter of cell of the portion of the foamed material under the transfer region of the foamed material is in a range of over 0 μm to 50 μm.

In a fifth aspect of the invention, it is preferable that the size of the gap portion under the non-transfer region is more than 500 μm, while the size of the gap portion under the transfer region is in a range of over 0 μm to 500μm.

According to the transfer apparatuses of the first through fifth aspects, the diameter of cell or the size of the gap of the portion of the foamed material forming the semiconductor layer under the non-transfer region is set to be larger than the diameter of foams or the size of the gap in the portion of the foamed material forming the semiconductor layer under the transfer region. This enables the improvement of the electrostatic attraction force of a recording paper P regardless of fluctuations in environment, especially at high temperatures and high humidities without reducing the image quality of the image obtained by fixing the transferred toner image as in the prior art.

In a sixth aspect of the invention, it is preferable that the non-transfer region includes a portion for attracting a top end portion of the transfer material in the carrying portion.

In a seventh aspect of the invention, it is preferable that the non-transfer region further includes a portion for attracting one side end portion of the transfer material serving as a standard for registration of the transfer material with respect to the transfer material carrying member, in the carrying portion.

According to the transfer apparatuses of the sixth and seventh aspects, a transfer material can be prevented from peeling off from the transfer material carrying member with reliability.

In an eighth aspect of the invention it is preferable that the portions of the semiconductor layer under the non-transfer region and under the transfer region, respectively, are formed by mutually different members.

According to the invention, the portions of the semiconductor layer under the non-transfer region and under the transfer region, respectively, are made with members which have mutually different diameters of cell or sizes of gaps. Consequently, the diameters of cell or gap of the portions of the semiconductor layer under the non-transfer region and under the transfer region, respectively, can be formed in mutually different sizes with reliability, which can improve the electrostatic attraction force with reliability.

In a ninth aspect of the invention, the transfer apparatus further comprises a gap forming member for forming a large gap portion in the non-transfer region, the gap forming member being interposed between the portion of the semiconductor layer under the non-transfer region and the dielectric layer, wherein a size of the gap portion formed by a foamed material forming the semiconductor layer is uniform in the state where the gap forming member is not interposed.

According to the transfer apparatus, such a simple construction as that the gap forming member is only interposed between the semiconductor layer and the dielectric layer under the non-transfer region can improve the electrostatic attraction force.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
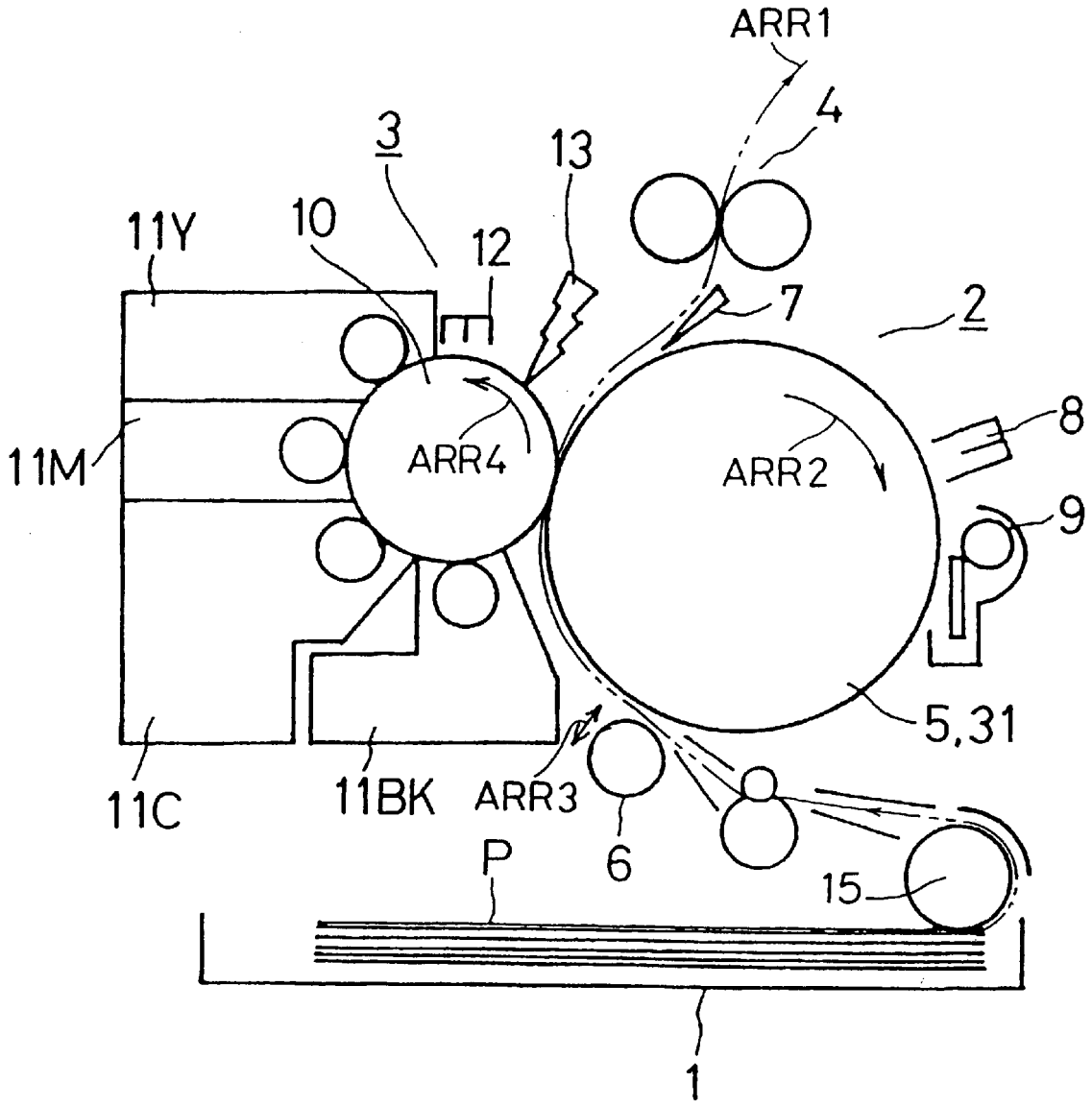
FIG. 1 is a schematic side view showing a color image forming apparatus using a transfer apparatus 2 of a first embodiment of the invention.

Now referring to the drawings, preferred embodiments of the invention are described below.

A color image forming apparatus using a transfer apparatus of a first embodiment of the invention will now be described with reference to FIG. 1. FIG. 1 is a schematic diagram of the construction of the color image forming apparatus. The color image forming apparatus is composed of: a paper feeding section 1 for stocking and feeding a recording paper P as a transfer material on which an image by toner is formed; a developing section 3 for forming a toner image; a transfer section 2 which is a transfer apparatus for transferring the toner image to the recording paper P; and a fixing section 4 for fusing and fixing the toner image transferred to the recording paper P. The transport path and transport direction of the transfer material in the color image forming apparatus are shown by an arrow ARR1.

In the transfer section 2, there is provided a cylindrical-shaped transfer drum 5 which is a transfer material carrying member for carrying the recording paper P by electrostatic attraction, and transferring the toner image of the developing section 3 to the recording paper P. The transfer drum 5 rotates in the direction shown by an arrow ARR2 about the central axis of the cylinder of the drum 5. In the transfer section 2, around the transfer drum 5, there are further provided: a ground roller 6 arbitrarily retractable with respect to the transfer drum 5 for applying a voltage to cause the electrostatic attraction of the recording paper P to the transfer drum 5; a guide member for guiding the recording paper P so as not to drop it down from the transfer drum 5; a peeling-off claw 7 for compulsively peeling off the transfer paper P electrostatically attracted onto the transfer drum 5: a discharger 8 for removing the charges on the transfer drum 5; and a cleaning section 9 for cleaning the transfer drum 5. An arrow ARR3 denotes the direction of movement of the ground roller 6.

In the developing section 3, there is provided a cylindrical-shaped photoreceptor drum 10 which is an image carrier coming in contact with the transfer drum 5 with pressure. The photoreceptor drum 10 is made of, for example, a grounded conductive aluminium plain tube, and is formed with an OPC film being applied onto its surface. The photoreceptor drum 10 rotates in the direction shown by an arrow ARR4 about the central axis of the cylinder of the drum 10. In the developing section 3, the developing containers 11Y, 11M, 11C, and 11Bk in which color toners of yellow, magenta, cyan, and black are stored, respectively, are further provided in a radial manner around the photoreceptor drum 10. There are further provided a charger 12 for charging the surface of the photoreceptor drum 10, and a cleaning blade 13 for scraping off a residual toner on the surface of the photoreceptor drum 10 to remove it out. As to every color toner, the toner image is formed on the photoreceptor drum 10.

That is, according to the photoreceptor drum 10, charging, exposure, development and transfer are repeated for every single color. Consequently, respective color toner images are superposedly transferred to the recording paper P electrostatically attracted onto the transfer drum 5. Accordingly, in the case of transfer of a color image, every time the transfer drum 5 rotates with respect to the recording paper P electrostatically attracted onto the transfer drum 5, a single color toner image is transferred to the recording paper P. Thus, a single full-color image is obtained through four rotations. The fixing section 4 includes a pair of fixing rollers for fusing the toner image at a prescribed temperature and under a prescribed pressure, and fixing it on the recording paper P. There is further provided a fixing guide for guiding the recording paper P peeled from the transfer drum 5 by the peeling-off claw 7 to the fixing rollers 4 after transfer of the toner image to the recording paper P on the transfer drum 5. There is also provided a discharging roller on the downstream side in the transport direction of the recording paper P of the fixing rollers 4, so that the recording paper P after fixing is discharged from the inside of the main body of the color image forming apparatus onto a discharge tray.

Figure 2:
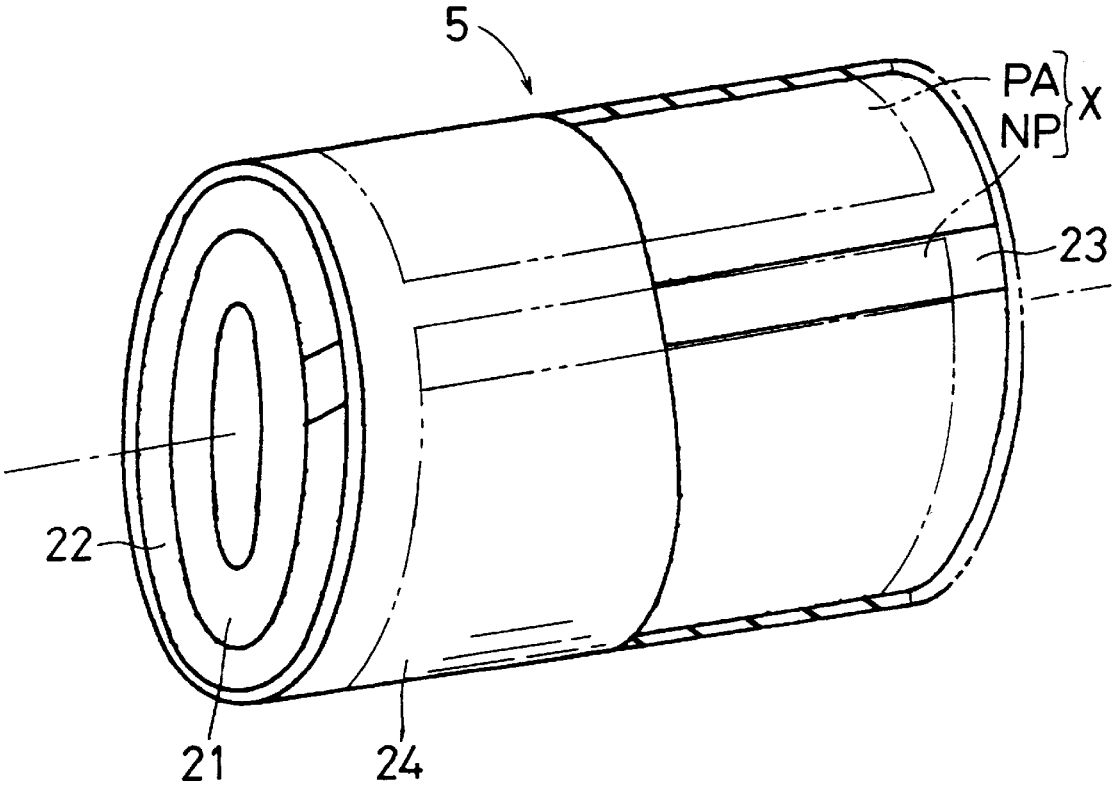
FIG. 2 is a perspective view of a transfer drum 5 in the transfer apparatus 2 of the first embodiment.

A description will now be given to the structure of the transfer drum 5 of the transfer apparatus for use in the color image forming apparatus with reference to FIG. 2. FIG. 2 is a perspective view illustrating the transfer drum 5 with its right-hand half conductive layer being broken away for easy understanding of the interior construction thereof.

The transfer drum 5 includes a conductive layer 21, first and second semiconductor layers 22 and 23, and a dielectric layer 24. The first and second semiconductor layers 22 and 23 are formed by foamed materials, respectively. The diameter of cell in the first semiconductor layer 22 is smaller than the diameter of cell in the second semiconductor layer 23. The diameters of cells in each of the semiconductor layers 22 and 23 represent the diameters of cells in the foamed materials forming the layers.

The transfer drum 5 uses the conductive layer 21 made of, for example, cylindrical-shaped aluminium as a carrying member frame, i.e., base material. The first and second semiconductor layers 22 and 23 each formed by a foamed elastic body having elastic property are disposed side by side on the surface of the conductive layer 21, and the dielectric layer 24 formed by a polymer film such as PVDF (polyvinylidene fluoride) is laminated on the surface of the semiconductor layers 22 and 23.

A recording paper carrying portion X which is a region on which the recording paper P can be electrostatically attracted is set within the entire side of the transfer drum 5, i.e., within the entire surface of the dielectric layer 24. For example, the recording paper carrying portion X is a residual portion within the entire surface of the dielectric layer 24 excluding opposite end portions of the surface. In the recording paper carrying portion X, a transfer region PA which is a region capable of opposing the photoreceptor roller 10 via the electrostatically attracted recording paper P is set. The region other than the transfer region PA in the recording paper carrying portion X is taken as a non-transfer region NP. For example, the transfer region PA comes in contact with the central portion of the recording paper P on attracting the recording paper, while the non-transfer region NP comes in contact with at least one portion of the end portions of the recording paper P on attracting the recording paper. Also, the transfer region PA is involved in transfer of the toner image, while the non-transfer region NP is not involved in the transfer. The width of the photoreceptor roller 10 is larger than the recording paper carrying portion X and equal to or smaller than the width of the dielectric layer 24 of the transfer drum 5.

The first semiconductor layer 22 is formed under the transfer region PA of the toner image within the recording paper carrying portion X of the transfer drum 5. The diameter of cell of the first semiconductor layer 22 theoretically becomes a diameter of more than 0 $\mu$m and less than 100 $\mu$m, and more preferably a diameter in a range of over 0 $\mu$m to 50 $\mu$m for obtaining high image quality transfer. The second semiconductor layer 23 is formed under the non-transfer region NP of the toner image within the recording paper carrying portion X of the transfer drum 5. The diameter of cell in the second semiconductor layer 23 theoretically becomes a diameter larger than 100 $\mu$m, and more preferably a diameter 500 $\mu$m or more for obtaining a stable electrostatic attraction force. In the first embodiment, the region to which the top end portion of the recording paper P is attracted in the recording paper carrying portion X is taken as a non-transfer region NP, while the residual region other than the non-transfer region NP in the recording paper carrying portion X is taken as a transfer region PA. That is, the second semiconductor layer 23 is formed in the region to which the top end of the recording paper P is attracted at the time when electrostatic attraction starts within the recording paper carrying portion X.

Thus, the second semiconductor layer 23 is formed in the portion from which electrostatic attraction of the recording paper P starts within recording paper carrying portion X. Consequently, the top end of the recording paper P will not peel off from the transfer drum 5, which enables the prevention of the occurrence of jam with reliability.

As foamed elastic members forming the first and second semiconductor layers 22 and 23, tonically conductive hydrin rubber, urethane rubber, carbon-dispersing type EPDM, or elastomer are used. To the conductive layer 21, a power source section as a voltage application means is electrically connected, so that a stable voltage is supplied over the entire circumference of the dielectric layer 24. In the embodiment, it is assumed that the power source section is a direct current power source Va, and the ground roller 6 is grounded. Also in the embodiment, the materials for the foamed materials forming the first and second semiconductor layers 22 and 23, respectively, are mutually equal, and only the diameters of cells in the foamed materials are different. Basically, the first and second semiconductor layers 22 and 23 are formed in a manner that a gap portion is not formed between the respective layers 22, 23 and the dielectric layer 24. However, in a certain method for forming the first and second semiconductor layers 22 and 23, foam cells in the neighborhood of the surfaces of the layers 22 and 23 on the dielectric layer 24 side may open on the surfaces. In this case, the cell becomes a gap portion.

Next, the mechanism of electrostatic attraction of the recording paper P will be described in detail with reference to FIGS. 3 and 4. The electrostatic attraction of the recording paper P onto the transfer drum 5 as in this method is caused by impartment of charges of an opposite polarity to that of the voltage applied to the dielectric layer 24 to the recording paper P resulting from contact charging with the ground roller 6. The mechanism of contact charging is composed of Paschen's discharge and charge injection.

Paschen's discharge is that, as the distance between the ground roller 6 and the dielectric layer 24 on the transfer drum 5 is approaching, and as the electric field strength brought to the micro-gap between the surface of the ground roller 6 and the surface of the dielectric layer 24 is strengthened, air dielectric breakdown occurs, and discharge occurs. Paschen's discharge occurs in the region R1 within the transfer section 2 as shown in FIG. 3. In the case where a voltage of the positive polarity is applied between the conductive layer 21 and the ground roller 6 with the ground roller 6 being grounded, that is, in the case where the voltage is applied so that the electric potential of the conductive layer 21 is higher than the electric potential of the ground roller 6, discharge occurs in a minute gap between the dielectric layer 24 and the ground roller 6. As a result, negative charges are accumulated on the surface of the recording paper P on a side opposite to the transfer drum 5. Alternatively, in the case where a voltage of the negative polarity is applied between the conductive layer 21 and the ground roller 6 in the state as described above, when discharge occurs in the gap, positive charges are accumulated on the surface of the recording paper P on a side opposite to the transfer drum 5.

Figure 3:
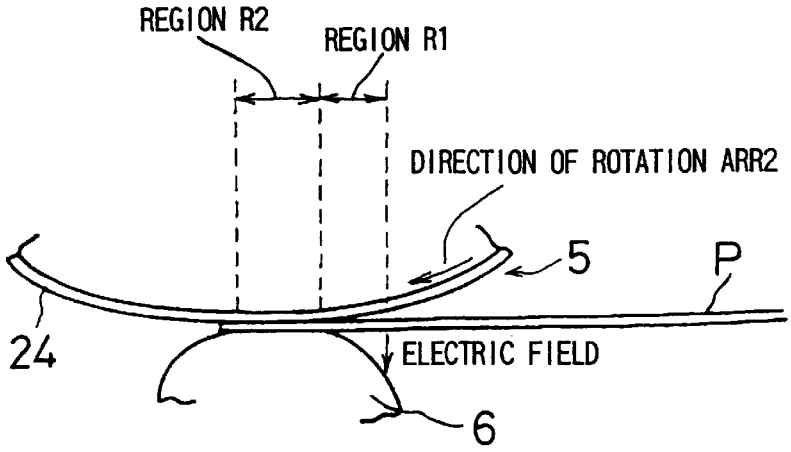
FIG. 3 is a partially enlarged view of the transfer apparatus 2 for illustrating the region where the Paschen's discharge and charge injection occur, and the mechanism of the Paschen's discharge and charge injection in the transfer apparatus 2 of the first embodiment.

Further, after the completion of the discharge, charge injection occurs at the nip between the transfer drum 5 and the ground roller 6, i.e., the region R2 within the transfer section 2 shown in FIG. 3, and negative charges are further accumulated on the surface of the recording paper P on the transfer drum 5 side. The equivalent circuit of the transfer section 2 at the time of the charge injection is shown in FIG. 4. The symbols in the circuit are as follows: Va denotes a direct current power source; r1 denotes the resistance of the first semiconductor layer 22; r2 denotes the contact resistance between the first semiconductor layer 22 and the dielectric layer 24; r3 denotes the resistance of the dielectric layer 24; r4 denotes the contact resistance of the recording paper P; r5 denotes the contact resistance between the recording paper P and the ground roller 6; c2 denotes the electrostatic capacity between the first semiconductor layer 22 and the dielectric layer 24; c3 denotes the electrostatic capacity of the dielectric layer 24; c4 denotes the electrostatic capacity of the recording paper P; and c5 denotes the electrostatic capacity between the recording paper P and the ground roller 6.

Figure 4:
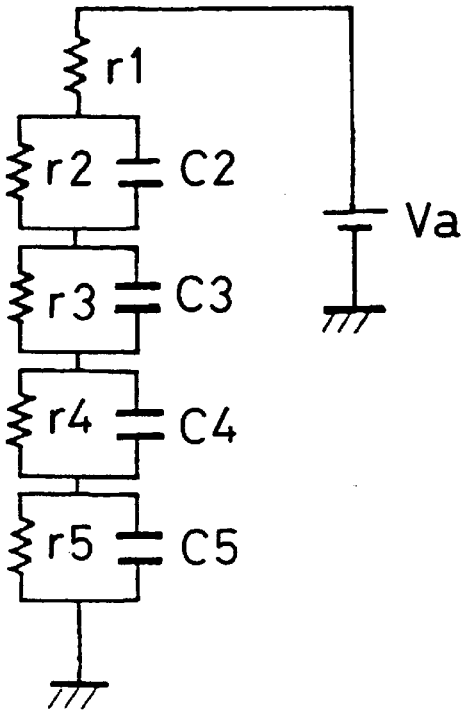
FIG. 4 is an equivalent circuit diagram at the time of charge injection of the transfer apparatus 2 of the first embodiment.

It is noted that FIG. 4 shows a case where the first semiconductor layer 22 is included in the region R2. In the case where the second semiconductor layer 23 is included in the region R2, the resistances r1 and r2, and the electrostatic capacity c2 of the foregoing circuit diagram can be properly changed into the resistance of the second semiconductor layer 23, the contact resistance between the second semiconductor layer 23 and the dielectric layer 24, and the electrostatic capacity between the second semiconductor layer 23 and the dielectric layer 24, respectively.

In order to obtain the amount of charges accumulated on the recording paper P, i.e., potential of the recording paper P, the potential difference across the electrostatic capacity c5 in the foregoing circuit is solved, provided that the charge amount (potential) charged by the Paschen's discharge is an initial potential. Consequently, the sum of the charged potentials of the recording paper P resulting from the Paschen's discharge and charge injection, respectively, becomes the final charged potential of the recording paper P. The analysis formula of the final charged potential V of the c5 obtained in this manner is as follows:

$$V=A\times(b'\times e^{B}-c'\times e^{C}) \quad (1)$$

wherein A, B, C, b' and c' in the formula 1 represent constants depending on the circuit of the transfer section 2, and concretely they depend on the resistance value and the electrostatic capacity of each of the layers 22 and 24.

Thus, the charge (potential) accumulatedon the recording paper P shows the opposite polarity to that of the potential applied to the dielectric layer 24. As a result, electrostatic attraction force arises between the recording paper P and the dielectric layer 24, and the recording paper P is electrostatically attracted onto the transfer drum 5. That is, it is considered that the higher is the charged potential on the recording paper P, the greater is the electrostatic attraction force onto the transfer drum 5.

Next, a description will now given to the electrostatic attraction force holding characteristics of the recording paper P. The charges (potential) accumulated on the recording paper P conceivably attenuates with the lapse of time. That is, it is important that the charges accumulated on the recording paper P are held without attenuating for keeping the recording paper P being electrostatically attracted onto the dielectric layer 24 with stability.

Then, the attenuation characteristics of the charges on the recording paper P electrostatically attracted onto the dielectric layer 24 are determined by analysis, leading to the following formula 2:

$$pV+q\log(V)=-(t/\epsilon S)+N \quad (2)$$

wherein p and q in the formula 2 represent constants depending on the resistance value of each of the layers 22 and 24, t represents a decay time of the charges on the recording paper P, $\epsilon$represents a relative dielectric constant of each of the layers 22 and 24, S represents the area of the recording paper P, N represents an integration constant, and V represents the charged potential of the recording paper P.

It is apparent from the formula 2 that the charged potential V on the recording paper P attenuates with the passage of a time t. It is also revealed that the attenuation rate of the charges on the recording paper P depends on the relative dielectric constant $\epsilon$ of each of the layers 22 and 24, and the resistance value of each of the layers 22 and 24, and the larger the relative dielectric constant is, or the higher the resistance value is, the lower the attenuation rate is. From the foregoing, the electrostatic attraction force holding characteristics of the recording paper P are improved in the case where the relative dielectric constant is large, or the resistance value is large. That is, the attraction performance is improved by making the gap large (making the diameter of cell large) in the first semiconductor layer 22.

However, it is known that in the case where the gap is made to be large, the transfer performance is reduced, especially light and shade arises in the solid portion, which adversely affects the quality of image. That is, in the case where foam cells exist in the first semiconductor layer 22, density nonuniformity resulting from the foam cells in the first semiconductor layer 22 may arise in an image which is transferred on a transfer material by use of the transfer drum 5. The density nonuniformity is one of the causes lowering the image quality of the transferred image, which noticeably appears in the case where the image is a so-called solid image. The minimum value of the diameter of cell of the first semiconductor layer 22 and the maximum value of the diameter of cell of the second semiconductor layer 23 are determined in response to the lowest permissible image quality of the transferred image and the lowest permissible attraction performance of the transfer material, respectively.

In consideration of the foregoing analysis results, in the case where the diameter of cell of the first semiconductor layer 22 is 100 μm or more, the image quality of an image transferred by use of the transfer drum 5 composed of the first semiconductor layer 22 with the diameter of cell, is degraded to be equal to or less than the lowest permissible image quality due to the density nonuniformity resulting from the foam cells in the first semiconductor layer 22. Therefore, in consideration of only the quality of image, it is preferable that the diameter of cell of the first semiconductor layer 22 is theoretically more than 0 μm and less than 100 μm. Furthermore, in the above case, when the diameter of cell of the first semiconductor layer 22 is in a range of over 0 μm to 50 μm, the cells hardly adversely affect the image quality of the transferred image, which is more preferable. Also considering that the first semiconductor layer 22 needs to be a foamed material with a predetermined hardness, for example, a so-called low-hardness foamed material and the particle size of toner used in a color image forming apparatus is to be downsized, it is preferable that the diameter of cell of the first semiconductor layer 22 is equal to or more than a value corresponding to about one tenths of the particle size of the toner. For instance, the value corresponding to one tenths of the particle size of the currently-used toner is 1 μm. On the basis of the two reasons as mentioned above, the most preferable permissible range of the diameter of cell of the first semiconductor layer 22 is from one tenths of the particle size of toner to 50 μm.

Also in consideration of the analysis results as mentioned above, in the case where the diameter of cell of the second semiconductor layer 23 is 0 μm or more and less than 100 μm, it becomes difficult that the transfer drum 5 reliably attracts the transfer material, regardless of the usage condition of the transfer drum 5. The usage condition includes, for example, an environment in which the transfer drum 5 is used and the type of the transfer material, that is, a so-called paper type. Therefore, in consideration of only the attraction performance, it is preferable that the diameter of cell of the second semiconductor layer 23 is theoretically 100 μm or more. In addition, when the diameter of cell of the second semiconductor layer 23 is 500 μm or more, the permissible range of the usage condition is extended up to a sufficient range in practical use, so that an attraction failure of the transfer material resulting from the usage condition hardly arises, which is more preferable. Also in consideration of only the relation between the thickness of the second semiconductor layer 23 and the diameter of cell, in the case where the diameter of cell is larger than, for example, one fifth of the thickness of the second semiconductor layer 23, the second semiconductor layer 23 becomes hard to exist as a foamed material. In this embodiment, the thickness of the second semiconductor layer 23 is about 5 mm. On the basis of the foregoing reasons, the most preferable permissible range of the diameter of cell of the second semiconductor layer 23 is from 500 μm to one fifths of the thickness of the second semiconductor layer.

In this specification, in the case where the upper limit value of a numerical range is not defined, the diameter of cell defined according to the numerical range includes all diameters that are equal to or more than the lower limit value of the numerical range or that are larger than the lower limit value, of all sizes of diameters of cells which can exist in the foamed material. That is, in the above case, the upper limit value of the numerical range is the diameter of the largest cell that can exist in the foamed material.

On the basis of the foregoing reasons, with the transfer section 2 of this embodiment, the diameter of cell in the first semiconductor layer 22 existing in the transfer region PA of the recording paper carrying portion X of the transfer drum 5 is set to a diameter in a range of from 1 μm to 50 μm, which results in high quality image transfer. Moreover, the diameter of cell in the second semiconductor layer 23 existing in the non-transfer region NP of the recording paper carrying portion X of the transfer drum 5 is set to a diameter in a range of from 500 μm to 1 mm, which results in stable electrostatic attraction force.

In the following, a description will now be given to a transfer apparatus of a second embodiment of the invention. The construction and behavior of the transfer apparatus of the second embodiment are the same as those of the transfer apparatus 2 of the first embodiment, except for the construction of the transfer apparatus. The construction and behavior of the color image forming apparatus using the transfer apparatus of the second embodiment are the same as those of the color image forming apparatus of the first embodiment, except for the construction that the transfer apparatus of the second embodiment is employed. Of the description on the transfer apparatus and the color image forming apparatus of the second embodiment, the part equal to the description on the transfer apparatus and the color image forming apparatus of the first embodiment is omitted.

Figure 5:
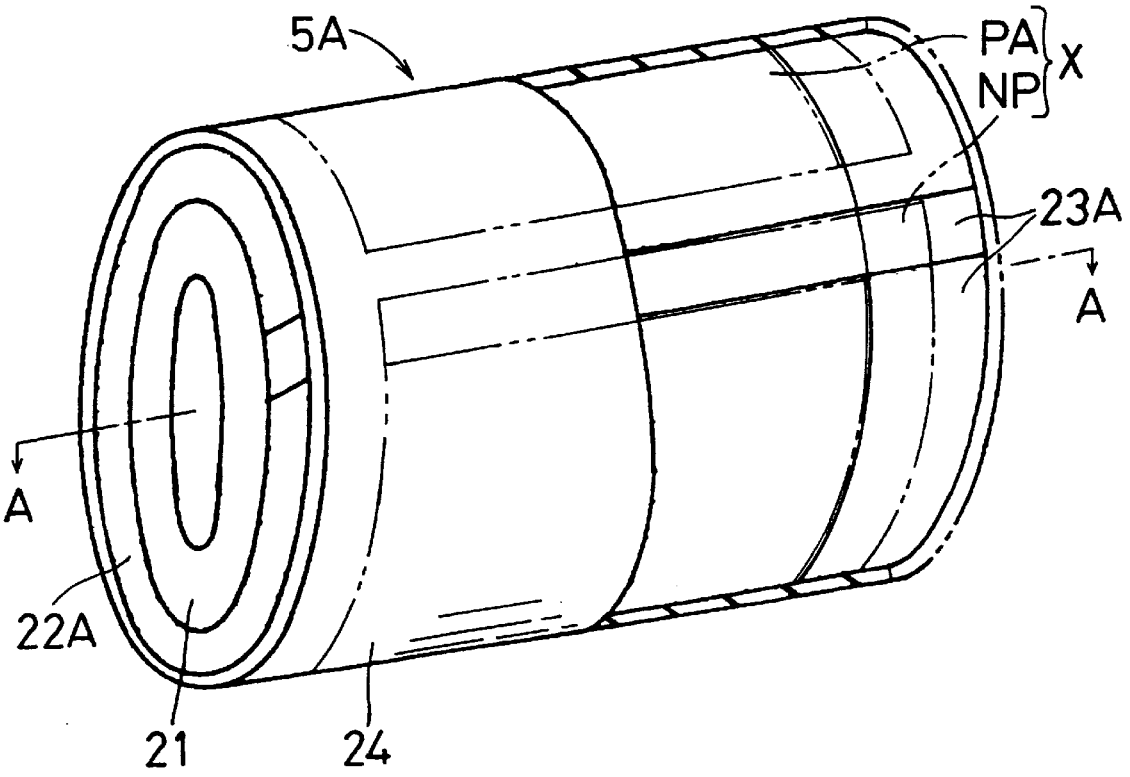
FIG. 5 is a perspective view showing a transfer drum 5A in a transfer apparatus of a second embodiment.

A description will now be given to the construction of a transfer drum SA in the transfer apparatus of the second embodiment with reference to FIG. 5. FIG. 5 is a perspective view of the transfer drum 5A. The transfer drum 5A includes a conductive layer 21, first and second semiconductor layers 22A and 23A, and a dielectric layer 24. It is noted that FIG. 5 shows the transfer drum 5A with its right-hand half dielectric layer 24 in the figure being broken away for easy understanding of the interior construction thereof. The diameter of cell in the first semiconductor layer 22A under the transfer region PA within the recording paper carrying portion X of the transfer drum 5A is set to a diameter in a range of over 0 μm to 50 μm. Meanwhile, the diameter of cell in the second semiconductor layer 23A under the non-transfer region NP of the toner image within the recording paper carrying portion X of the transfer drum 5A is set to a diameter of 500 μm or more. In the second embodiment, the non-transfer region NP is a region onto which the top end portion and any one side end portion of the two side end portions of the recording paper P are attracted, respectively, within the recording paper carrying portion X, at the time of attraction of the recording paper P, while the transfer region PA is a residual region other than the non-transfer region NP within the recording paper carrying portion X.

That is, in the color image forming apparatus of the second embodiment, in the case where at least one portion of one side end of the recording paper P is used as a standard for registration of the recording paper P in inserting the recording paper P into the transfer section 2, and the registration of the photoreceptor drum 10 and the recording paper, the second semiconductor layer 23A is formed not only in the portion for attracting the top end portion of the recording paper P, but also in the portion for attracting at least one portion of the one side end of the recording paper P within the recording paper carrying portion X. It is noted that the one side end corresponds to the right-hand end of the recording paper P in FIG. 5. In the color image forming apparatus, the widths of plural types of recording papers P handled by the apparatus are different from each other, so that one side end of the recording paper P is often used as a standard for registration of the recording paper P. The central portion of the recording paper P may be used as the standard.

Accordingly, the second semiconductor layer 23A attracts the top end portion and one side end serving as a standard of the recording paper P, and hence the electrostatic attraction force acting on the recording paper P of the transfer drum 5A can be improved, and the peeling off of the recording paper P from the transfer drum 5A can be prevented with reliability.

Below, a description will now be given to a transfer apparatus of a third embodiment of the invention. The construction and behavior of the transfer apparatus of the third embodiment are the same as those of the transfer apparatus of the second embodiment, except for materials forming the first and second semiconductor layers 22A and 23A. The construction and behavior of the color image forming apparatus using the transfer apparatus of the third embodiment are the same as those of the color image forming apparatus of the second embodiment, except for the construction that the transfer apparatus of the third embodiment is employed. Of the description on the transfer apparatus and the color image forming apparatus of the third embodiment, the part equal to the description on the transfer apparatuses and the color image forming apparatuses of the first and second embodiments is omitted.

Figure 6:
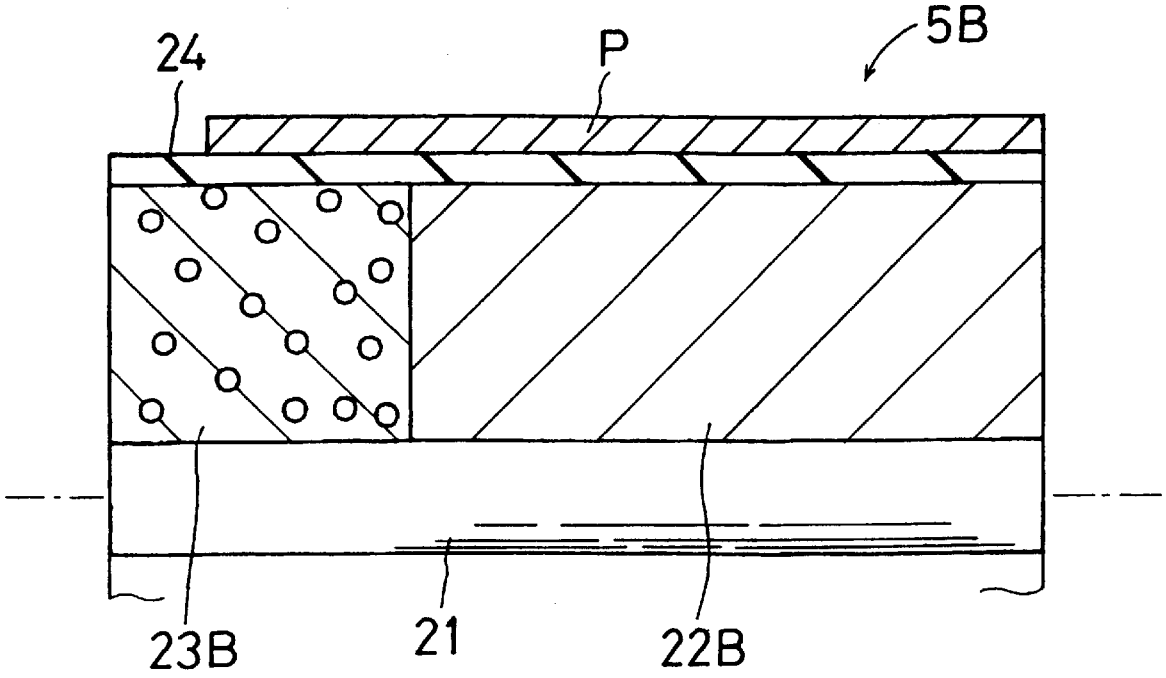
FIG. 6 is a sectional view showing a transfer drum 5B in a transfer apparatus of a third embodiment.

A description will now be given to the construction of the transfer drum 5B within the transfer apparatus of the third embodiment with reference to FIG. 6. FIG. 6 is a sectional view of the transfer drum 5B. The transfer drum 5B of the third embodiment has the same construction as that of the transfer drum 5A of the second embodiment, and the foamed materials forming the first and second semiconductor layers 22B and 23B are mutually different. It is noted that FIG. 6 shows a cross section of a drum having the same construction as that of the transfer drum of FIG. 5 cut along a virtual plane passing the portion attracting any one side end of the recording paper P in the second semiconductor layer 23B, and including the rotation axis of the transfer drum. Also, the arrangement of the first and second semiconductor layers 22B and 23B of the transfer drum 5B is not limited to the foregoing arrangement. The same construction as that of the transfer drum of the transfer apparatus 2 of the first embodiment may be adopted, and other arrangements may be adopted.

In the same manner as in the first embodiment, the diameter of cell in the first semiconductor layer 22B under the transfer region PA within the recording paper carrying portion X of the transfer drum 5B is set to a diameter in a range of over 0 $\mu$m to 50 $\mu$m, while the diameter of cell in the second semiconductor layer 23B under the non-transfer region NP within the recording paper carrying portion X of the transfer drum 5B is set to a diameter of 500 $\mu$m or more. For this reason, the first and second semiconductor layers 22B and 23B are formed by mutually different foamed materials, respectively. The diameter of cell of the foamed material forming the first semiconductor layer 22B is smaller than the diameter of cell of the foamed material forming the second semiconductor layer 23B. For example, the first semiconductor layer 22B is formed of a foamed material having a small diameter of cell, composed of, for example, an ionically conductive hydrin rubber manufactured by Sumitomo Rubber Industries Ltd., while the second semiconductor layer 23B is formed of EPDM of a carbon-dispersing type manufactured by Kuraray Plastic Co., Ltd., having a large diameter of cell. This enables the color image forming apparatus to obtain a stable attraction performance without a reduction in image quality in the same manner as in the embodiments 1 and 2. Thus, it has become possible to obtain a stable attraction force and implement high quality image transfer in every environment, especially, in an environment at high temperatures and high humidities.

A material for forming the first and second semiconductor layers 22B and 23B may be another material other than the hydrin rubber and the EPDM as mentioned above, in the case of using a semiconductor material which causes the efficiency of transfer of an image with the predetermined quality of image by use of the transfer drum 5B to which foamed materials formed by use of the material other than the hydrin rubber and the EPDM are attached as the first and second semiconductor layers 22B and 23B, and the attraction performance of the transfer drum 5B, to be equal to or more than a predetermined standard of performance and efficiency, respectively. The reason for using the hydrin rubber and the EPDM as the first and second semiconductor layers 22B and 23B is that the hydrin rubber and the EPDM are semiconductor materials having a volume resistivity of $10^9\Omega$cm ±1 digit, and that the transfer drum 5B to which 5 mm-thickness of foamed materials formed by use of the hydrin rubber and the EPDM are attached as the first and second semiconductor layers 22B and 23B is capable of performing transfer of an image with a so-called high quality of image at a high efficiency and is provided with a sufficient attraction performance in practical use. Furthermore, the hydrin rubber and the EPDM are the most preferable because mass production of the transfer drum 5B by use of these materials is facilitated and the manufacturing cost of the transfer drum 5B is reduced as compared with any cases of using other materials.

Below, a description will now be given to a transfer apparatus of a fourth embodiment of the invention, and the color image forming apparatus using the transfer apparatus. The construction of the color image forming apparatus of the fourth embodiment is the same as that of the color image forming apparatus of the first embodiment, except that the transfer apparatus is the one in accordance with the fourth embodiment. Of the description on the transfer apparatus and the color image forming apparatus of the fourth embodiment, the description on the part equal to the color image forming apparatuses of the first to third embodiments is omitted. Also,the materials and numeric values are included in the following description as illustration, and hence other materials and numeric values are acceptable.

Figure 7:
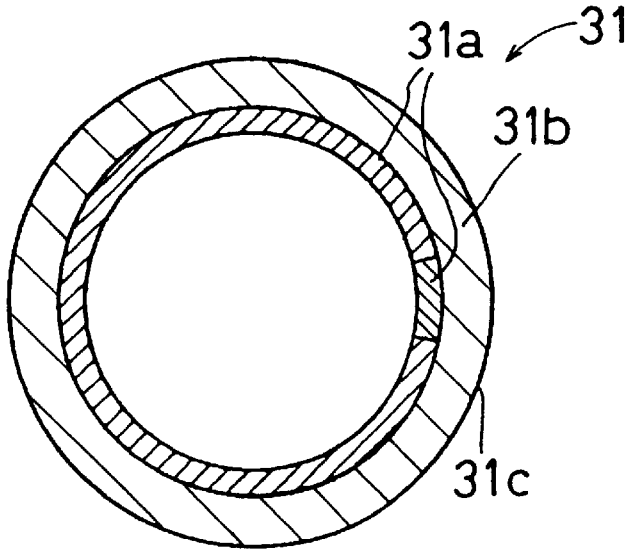
FIG. 7 is a transverse cross section showing a transfer drum 31 in a transfer apparatus of a fourth embodiment.
Figure 8:
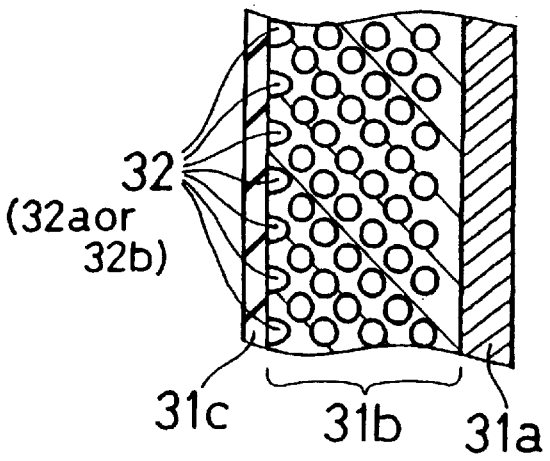
FIG. 8 is a partially enlarged cross section showing the transfer drum 31 of the fourth embodiment.

FIG. 7 is a cross section of the transfer drum 31 of the transfer apparatus of the fourth embodiment. FIG. 8 is a partially enlarged view of the transfer drum 31. The transfer drum 31 includes a drum frame 31*a*, foamed rubber 31*b*, and a dielectric layer 31*c*. An aluminium cylinder having a diameter of 130 mm is used as the drum frame 31*a*. The transfer drum 31 is so constructed that a plate-like foamed rubber 31*b* with a thickness of 5 mm is wrapped around the entire side of the drum frame 31*a*, and around the foamed rubber 31*b*, is further wrapped a dielectric sheet made of PVDF with a thickness of 75 $\mu$m as the dielectric layer 31*c*. The foam cells in the neighborhood of the surface P1 of the foamed rubber 31*b* on the dielectric layer 31*c* side open toward the surface. This results in the formation of the gaps 32 between the foamed rubber 31*b* and the dielectric layer 31*c*. In this embodiment, the foam cells in the foamed rubber 31*b* bring the same effect as the gaps 32. In the fourth embodiment, the size of the gaps 32 is the diameter of cells serving as gaps.

In the transfer drum 31, in the same manner as in the transfer drum 5, the recording paper carrying portion X, the transfer region PA, and the non-transfer region NP are set. Further, it is assumed that, in the fourth embodiment, the non-transfer region NP is a region onto which the top end portion and opposite side ends of the recording paper P are attracted at the time of attraction of the recording paper within the recording paper carrying portion X, while the transfer region PA is a residual region other than the non-transfer region NP within the recording paper carrying portion X. The diameter of cell in the portion existing in the transfer region PA in the foamed rubber 31*b* is smaller than the diameter of cell in the portion existing in at least one portion of the non-transfer region NP of the foamed rubber 31*b*. The drum frame 31*a* is an electric conductive member, while the foamed rubber 31*b* is a foamed material of a semiconductor. The construction of the transfer apparatus of the fourth embodiment is the same as that of the transfer apparatus of the second embodiment, except that the transfer apparatus has the construction shown in FIG. 7. It is noted that FIG. 7 shows a cross section of the transfer drum 31 cut along the virtual plane perpendicular to the central axis of the rotation of the drum. Referring now to FIG. 8, the circles in the foamed rubber 31*b* schematically illustrate the foam cells in the foamed rubber.

A description will now be given to the method for forming the image in the color image forming apparatus of the fourth embodiment with reference to FIG. 1. In the following description, it is assumed that the diameter of the photoreceptor drum 10 is 70 mm. The photoreceptor drum 10 is rotated in the direction shown by the arrow ARR 4 by a driving apparatus, and the surface of the photoreceptor drum 10 is uniformly charged to −600 V by the charger 12. After such charging, a plurality of electrostatic latent images each corresponding to its respective color are successively (on a color-by-color basis) formed on the surface of the photoreceptor drum 10.

Then, the recording paper P is carried out of the paper feeding section 1 by a paper feeding roller 15, and the recording paper P is electrostatically attracted onto the transfer drum 31 (transfer drum 5 in FIG. 1) by the ground roller 6. A direct-current voltage of several hundreds V to 3 kV is applied between the ground roller 6 and the transfer drum 31 at the time of electrostatic attraction. The resistance value of the ground roller 6 in this stage may be properly a value from a sufficient resistance value when the roller 6 has an electric conductivity to approximately $10^6$ Ωcm. With the recording paper P attracted onto the transfer drum 31, the registration of the top end portion thereof is conducted so as to be in synchronism with the toner image on the photoreceptor drum 10. Then, the recording paper P is applied with a voltage of the opposite polarity to that of the toner, +1.3 kV herein, so that the toner image is transferred to the recording paper P.

After transfer, toner residue which is not transferred remains on the photoreceptor drum 10, and hence it is cleaned by the cleaning blade 13. Up to this point, the formation and transfer of the toner image for one color are completed. After cleaning, uniform charging is performed again by the charger 12. After charging, for example, in the case where the toner of the first color is a black toner image, the toner image of another color, for example, toner image of cyan is formed by development by means of a developing container 11C after the formation of the electrostatic latent image in the same manner as in the case of the black toner image. Thus, the cyan toner image is transferred in a superposed relation on the recording paper P onto which the black toner image has been transferred. In the same manner, after the formation of electrostatic latent images, the magenta toner image and yellow toner image formed by development by means of the developing containers 11M and 11Y, respectively, are successively transferred in a superposed relation onto the recording paper P. This results in a full-color image in which toner images of four colors of yellow toner, magenta toner, cyan toner, and black toner are superposed one on another.

The recording paper P on the transfer drum 31 is peeled off from the top of the transfer drum 31 by the peel-off claw 7 after the completion of transfer of toner images of all colors. Then, the four-color toner image on the recording paper P is fused with application of heat and pressure to be fixed on the recording paper P as a permanent image by the fixing section 4.

Next, a detail description will now be given to the function of the transfer drum 31 in the transfer apparatus of the embodiment 4. Especially, a description will be given to the improvement in attraction force of the recording paper P onto the transfer drum 31 at high temperatures and high humidities of a temperature of 30° C. and a humidity of 80%.

As described above, the transfer drum 31 is made of the drum frame 31*a*, foamed rubber 31*b*, and the dielectric layer 31*c* as shown in FIGS. 7 and 8. The diameter of cell of the portion in the non-transfer region NP of the foamed rubber 31*b* is set to a diameter of cell larger than that of the portion in the transfer region PA. In this manner, use of the foamed rubber 31*b* results in the formation of the gap 32 between the foamed rubber 31*b* and the dielectric layer 31*c*. Furthermore, a change in diameter of cell of the portion in the non-transfer region NP and in the portion in the transfer region PA of the foamed rubber 31*b* changes the amount of gaps, i.e., size of the gaps 32 in the two regions NP and PA.

Further, the ground roller 6 is retractably provided with respect to the transfer drum 31. Consequently, a discharge occurs in the gap between the recording paper P and the ground roller 6 due to the potential difference between the potential imparted to the drum frame 31*a* of the transfer drum 31 and the potential of the ground roller 6. Thus, charges are induced on the contact surface of the recording paper P with the ground roller 6 due to the discharge, resulting in the generation of the electrostatic attraction force on the recording paper P.

This electrostatic attraction force is Coulomb's force between the charges held on the surface of the recording paper P and the charges held on the drum frame 31*a* of the transfer drum 31 by the application of a voltage. The smaller the size of the gap 32 between the dielectric layer 31*c* and the foamed rubber 31*b* is, i.e., the smaller the area of the opening of the foam cell resulting in the gap 32, or the diameter of cell is, the larger the contact area between the dielectric layer 31*c* and the foamed rubber 31*b* becomes. Accordingly, the charges of the dielectric layer 31*c* are likely to escape from a portion where the dielectric layer 31*c* and the foamed rubber are adhered to each other, and hence the contact resistance between the dielectric layer 31*c* and the foamed rubber 31*b* is reduced. In the case where the size of the gap 32 is small, the charges held on the surface of the recording paper P passes through the dielectric layer 31*c* of the transfer drum 31 due to a reduction in resistance resulting from moisture absorption of the recording paper P in an environment at high temperatures and high humidities. Further, they flow through the foamed rubber 31*b* to the drum frame 31*a* with ease due to the low contact resistance between the dielectric layer 31*c* and the foamed rubber 31*b*. Consequently, the electrostatic attraction force of the recording paper P is reduced, which makes it impossible to attract and hold the recording paper P onto the transfer drum 31.

However, the larger the size of the gap 32 between the dielectric layer 31*c* and the foamed rubber 31*b* is, the smaller the contact area between the dielectric layer 31*c* and the foamed rubber 31*b* becomes. Accordingly, the contact resistance of both the members 31*b* and 31*c* increases. This is because in the gap portion, air interposed between the dielectric layer 31*c* and the foamed rubber 31*b* acts as insulation and hence the charges of the dielectric layer 31*c* are hard to pass through the gap portion and escape. In the case where the size of the gap 32 is large, even if the resistance of the recording paper P is reduced under the environment at high temperatures and high humidities, the charges held on the surface of the recording paper P will not flow to the foamed rubber 31*b* with ease due to the high contact resistance between the dielectric layer 31*c* and the foamed rubber 31*b* to be held on the recording paper P. Consequently, the attraction and holding of the recording paper P onto the transfer drum 31 are sufficiently conducted.

The following first experiment is conducted in order to study the relationship between the electrostatic attraction force and the size of the gap. By use of five transfer drums 31 each having a different size of the gap 32 under the non-transfer region NP within the recording paper carrying portion X, the recording paper P is held on each transfer drum 31 only by the ground roller 6. Thus, the evaluation is conducted for the electrostatic attraction force by the number of rotations whereby each transfer drum 31 can hold the recording paper P. In this experiment, an OHP sheet requiring stronger electrostatic attraction force is used to carry out the experiment. In the experiment, the voltage to be applied to the drum frame 31*a* of the transfer drum 31 is set to 2.5 kV. The physical properties of the members of the transfer drum 31 other than the gap 32 used in the experiment are as follows.

Dielectric layer 31*c*: Material PVDF, Resistivity $10^{13}$ Ωcm, Thickness 75 μm Foamed rubber 31*b*: Material hydrin rubber, Resistivity $10^{8}$ Ωcm, Thickness 5 mm The result of the experiment is shown in table 1.

TABLE 1

| Size of gap in non-transfer region | Number of rotations enabling holding |
|---|---|
| 200 μm | 0 |
| 400 μm | 0.5 |

TABLE 1-continued

| Size of gap in non-transfer region | Number of rotations enabling holding |
|---|---|
| 500 μm | 1.0 |
| 600 μm | 1.5 |
| 800 μm | 4 |

Transfer of toners of four colors is required for conducting a color image forming. Accordingly, the formation of one full-color image requires four or more rotations of the transfer drum 31. The recording paper P comes in contact with the photoreceptor drum 10 each time the toner image is transferred. Consequently, charges are newly imparted onto the recording paper P, and hence it is sufficient that the transfer drum 31 has a capability for holding the recording paper P during one or more rotations.

Considering the foregoing, based on the results of the experiment, in the case where the size of the gap 32 under the non-transfer region NP is larger than 500 μm, the transfer drum 31 is capable of holding the recording paper P during one or more rotations.

However, the larger the gap 32 of the foamed rubber 31*b* is made, the more likely the partial transfer nonuniformity of the toner is to occur. The transfer voltage set for the transfer of the toner image is applied to the drum frame 31*a*. However, the resistance of the dielectric layer 31*c* is very high as compared with the resistance of the foamed rubber 31*b*, and hence most of the voltage applied to the transfer drum 31 is applied to the dielectric layer 31*c*. Also, the resistance of the space in the gap 32, i.e., the gap portion is higher than that of the dielectric layer 31*c*. Accordingly, the larger the gap 32 is, the much higher the voltage applied to the gap portion becomes. For this reason, in the case where there exists the gap 32 between the foamed rubber 31*b* and the dielectric layer 31*c*, the voltage applied to the dielectric layer 31*c* becomes lower as compared with the voltage applied to the dielectric layer 31*c* in the case where there is no gap between the foamed rubber 31*b* and the dielectric layer 31*c*. This is because in the case where there is a gap, air exists between the dielectric layer 31*c* and the foamed rubber 31*b* and the dielectric constant of air is lower than that of the foamed rubber. The voltage applied to the dielectric layer 31*c* is a voltage to be actually used for toner transfer. When this voltage changes, the transfer efficiency of the toner changes.

Table 2 shows the calculation results of the electric field distribution on the surface of the dielectric layer 31*c* in the cases where the sizes of the gap 32 between the foamed rubber 31*b* and the dielectric layer 31*c* are 600 μm and 300 μm, respectively.

TABLE 2

| | | Size of gap | |
|---|---|---|---|
| | | 300 μm | 600 μm |
| Electric field of dielectric layer | Central portion of gap | 30 kV/m | 7 kV/m |
| | Contact portion between foamed rubber and dielectric layer | 60 kV/m | 60 kV/m |

The parameters used for the calculation of the electric field are as follows.

Voltage applied to the drum frame of the transfer drum: 2 kV

Surface potential of the photoreceptor drum: −700 V Dielectric constant foamed rubber: 3, dielectric layer: 10

Volume resistivity foamed rubber: $10^8$Ωcm, dielectric layer: $10^{13}$Ωcm

Number of foams per 5 mm 9.2 (600 μm), 18.5 (300 μm)

The calculation is carried out using the finite element method with the shape of foams being approximated to a square.

Table 2 indicates that, in the case where the size of the gap 32 is 600 μm, the electric field of the center of the portion of the gap 32 of the electric field used for toner transfer in the neighborhood of the dielectric layer 31*c* is reduced to close to about 10% relative to the electric field in the portion at which the foamed rubber 31*b* and the dielectric layer 31*c* are in contact, while in the case where the size of the gap 32 is 300 μm, it is reduced only to the order of about 50%.

The following second experiment is carried out in order to study the relationship between transfer nonuniformity and the size of the gap based on the results of table 2. By use of color image forming apparatuses having five transfer drums each having a different size of the gap 32 under the transfer region PA within the recording paper carrying portion X, and the apparatuses each having the same construction as that of FIG. 1, color toner images each with a predetermined pattern are printed on recording paper. Then, whether there is observed transfer nonuniformity or not, on the resulting image on the recording paper. The physical properties of the members other than the gap 32 of the color image forming apparatuses, and the parameters of the apparatuses are as follows:

Dielectric layer Material: PVDF, Volume resistivity: $10^{13}$ Ωcm, Thickness: 75 μm, Foamed rubber Material: hydrin rubber, Volume resistivity: $10^8$ Ωcm, Thickness: 5 mm Transfer voltage 1.4 kV Surface potential of photoreceptor drum −600 V Toner particle size 10 μm Table 3 shows the results of the study on the relationship between the transfer nonuniformity occurring on the image actually printed and the size of the gap based on the results of the experiment.

TABLE 3

| Size of Gap | Presence or absence of transfer nonuniformity |
|---|---|
| 200 μm | ○ |
| 400 μm | ○ |
| 500 μm | ○ |
| 600 μm | X |
| 800 μm | X |

○: Transfer nonuniformity is not observed
X: Transfer nonuniformity is observed

The results of table 3 reveals that when the size of the gap 32 is 600 μm or more, transfer nonuniformity arises. The foregoing calculation results and the actual transfer results indicate that the transfer nonuniformity occurs when the size of the gap 32 is 600 μm or more. This reveals that there is no occurrence of transfer nonuniformity in the case where the size of the gap 32 is set to be in a range of over 0 μm to 500 μm.

Figure 9:
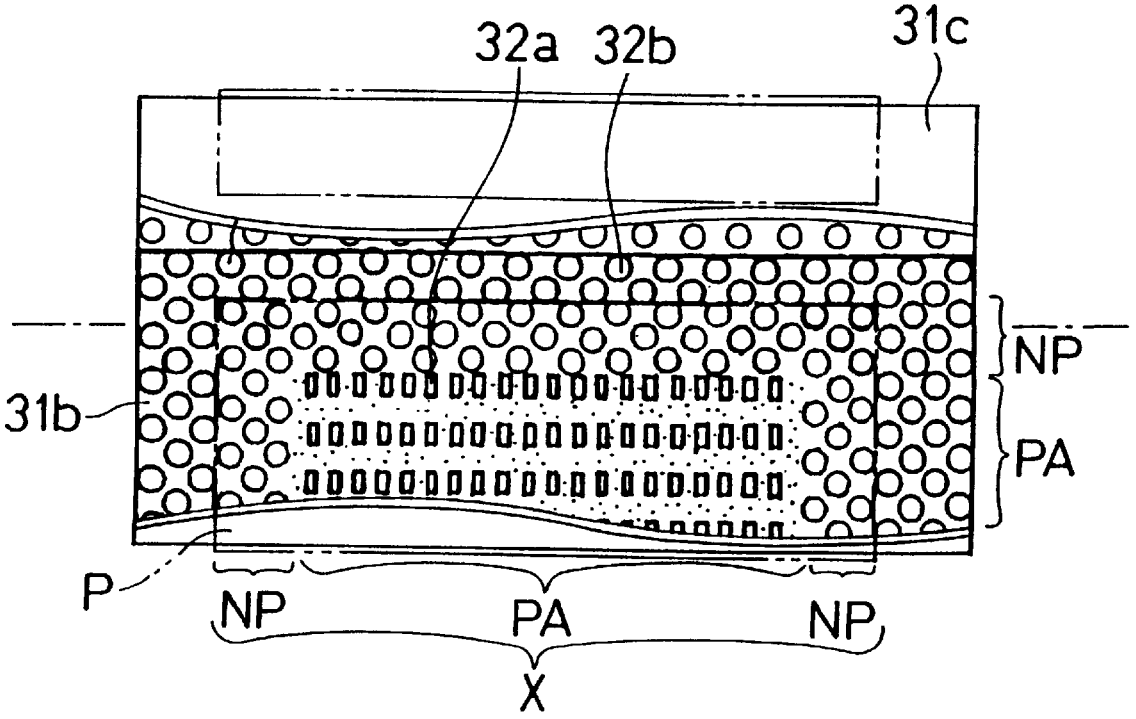
FIG. 9 is an elevational view showing the transfer drum 31 of the fourth embodiment.

As described above, when the compatibility between the electrostatic attraction of the recording paper P to the transfer drum 31 and the image quality based on the toner transfer is considered, it is indicated that there is no size of the gap 32 achieving the compatibility. Accordingly, it is required that the size of the gap 32 under the non-transfer region NP is set to be larger than 500 μm for maintaining the electrostatic attraction force. Meanwhile, it is required that the size of the gap 32 under the transfer region PA is set to be 500 μm or less to prevent the occurrence of the transfer nonuniformity. In the embodiment 4, as shown in FIG. 9, the gap 32*a* of the non-transfer region NP of the recording paper carrying portion X of the foamed rubber 31*b* is formed with a size of 800 μm of an optimum value, while the gap 32*b* of the transfer region PA is formed with a size of 300 μm of an optimum value. It is noted that the region within the top end portion and opposite side end portions of the recording paper P in the recording paper carrying portion X is taken as the non-transfer region NP. As a result, the recording paper P is attracted to a position shown with a virtual line. Although in FIG. 9 the gap 32*b* of the transfer region PA is shown with a rectangle, it is for showing that the gap 32*b* is different from the gap 32*a* in the non-transfer region NP. The actual gap 32*b* is spherical.

Below, a description will now be given to a transfer apparatus of a fifth embodiment of the invention, and the color image forming apparatus using the transfer apparatus. The construction and behavior of the transfer apparatus and the color image forming apparatus of the fifth embodiment are the same as those of the transfer apparatus and the color image forming apparatus of the fourth embodiment, except for the construction of the transfer drum. Of the description on the transfer apparatus and the color image forming apparatus of the fourth embodiment, the description on the part equal to the color image forming apparatuses of the first to third embodiments is omitted. The materials and numeric values are included in the following description as illustration, and hence other materials and numeric values are acceptable.

Figure 10:
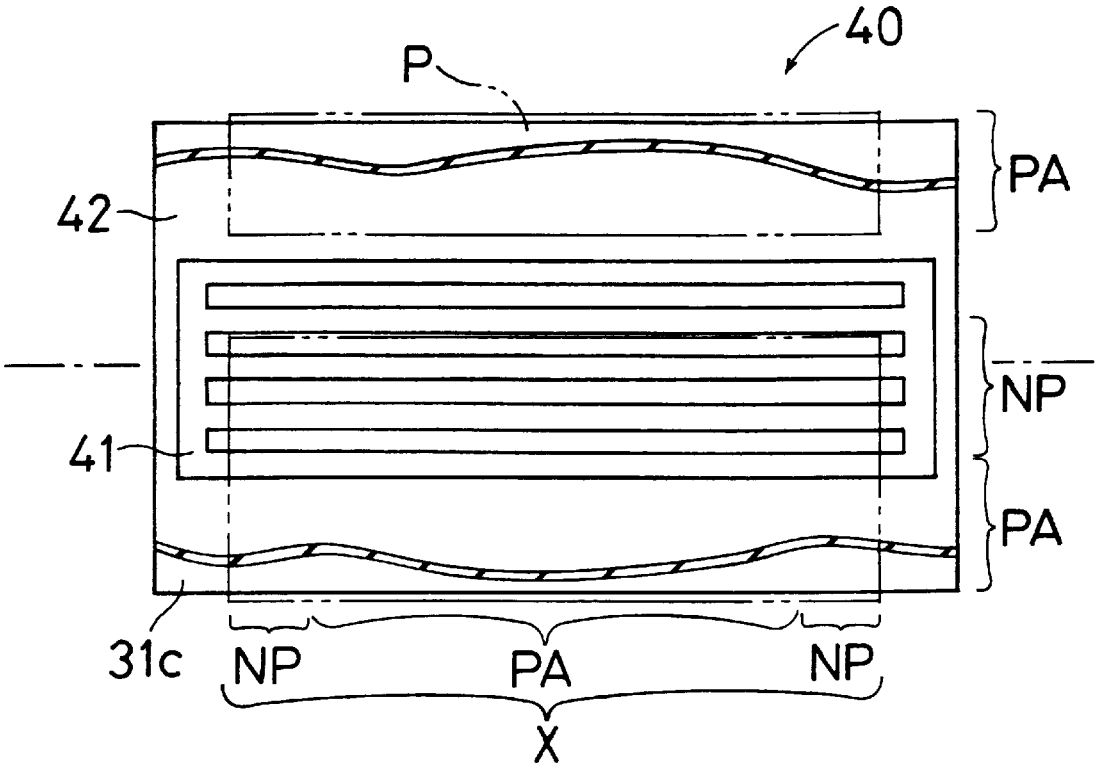
FIG. 10 is an elevational view showing a transfer drum 40 in a transfer apparatus of a fifth embodiment.
Figure 11:
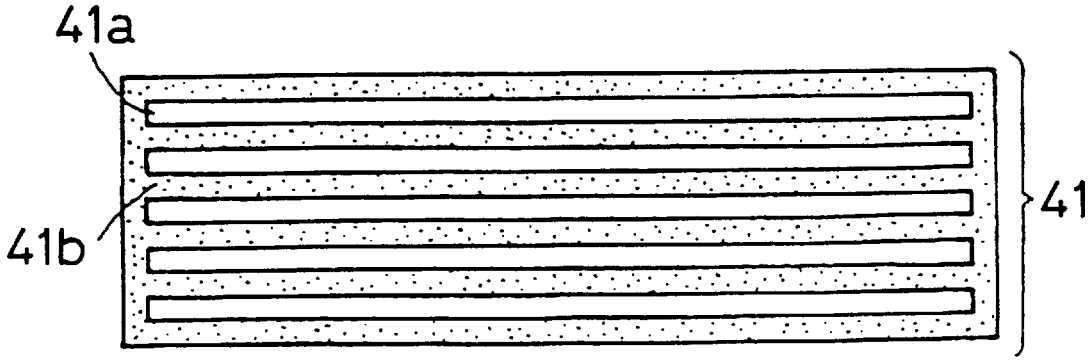
FIG. 11 is an elevational view showing a TX sheet 41 which is a gap forming member existing in the transfer drum 40 of the fifth embodiment.

FIG. 10 is a plan view of a transfer drum 40 of the transfer apparatus of the fifth embodiment. The transfer drum 40 includes a drum frame 31*a*, a foamed rubber 42, a dielectric layer 31*c*, and a different member 41 to be interposed between the dielectric layer 31*c* and the foamed rubber 42. The foamed rubber 42 is the plate-like one with a predetermined thickness, and it is wrapped around the drum frame 31*a*. The dielectric layer 31*c* is disposed on the foamed rubber 42. The diameters of cells of the portions in the non-transfer region NP and transfer region PA in the foamed rubber 42 are mutually equal. The different member 41 is interposed between the dielectric layer 31*c* and the portion in the non-transfer region NP of the foamed rubber 42. The different member 41 is interposed for mutually changing the amounts of gaps (size of the gap) between the dielectric layer 31*c* and the foamed rubber 42 in the non-transfer region NP and the transfer region PA, respectively. As the different member 41, for example, a TX sheet 41 (the material is polycarbonate) manufactured by Kureha Chemical Industry Co., Ltd., is used. FIG. 11 is a plan view of the TX sheet 41. The TX sheet 41 has a thickness of 300 μm, and in the TX sheet 41, a plurality of slits 41*a* each obtained by cutting a 2-mm-wide portion away from the sheet are formed in parallel to one another at intervals of 4 mm.

Thus, the TX sheet 41 is interposed between the foamed rubber 42 and the dielectric layer 31*c* of the non-transfer region NP. This enables the amounts of gaps (sizes of the gap) on the non-transfer region NP and the transfer region PA to be changed in the same manner as in the embodiment 4. In the same procedure and under the same conditions with the experiment carried out in the fourth embodiment, an experiment of the electrostatic attraction and toner transfer of the recording paper P is carried out by use of the transfer drum 40. As a result, a sufficient electrostatic attraction force can be obtained even under the environment at high temperatures and high humidities, and there is no occurrence of transfer nonuniformity on the image. The reason for using the TX sheet 41 as the different member is that the dielectric constant of polycarbonate, which is the material of the sheet, is high enough for practical use, the thickness of the sheet is uniform, and hence the sizes of a plurality of gaps formed by the TX sheet between the dielectric layer 31*c* and the foamed rubber 42 can be easily made to be equal to each other.

As described above, in the fourth and fifth embodiments, the electrostatic attraction force of the recording paper P onto the transfer drum 31 or 40 becomes the weakest on the top end portion side and the rear end portion side of the recording paper P. Accordingly, it is most adequate that the diameter of cell of the portion attracting the top end side and rear end side of the recording paper P in the foamed rubber is formed in a size larger than that of the residual portion for increasing the electrostatic attraction force of the recording paper P on the top end side and the rear end side. When different-sized sheets of the recording paper P are used, even if the position to which each top end of a plurality of the different-sized sheets of the recording paper P is attracted is constantly set at the same position, the position attracting the rear end of each sheet of recording paper on the transfer drum 5 will not fall at the same position. Therefore, when the color image forming apparatus uses sheets of the recording paper P with a variety of sizes, the diameter of cell of the portion attracting the top end portion of the recording paper P in the foamed rubber can be properly formed in a size larger than that of the residual portion.

This is attributable to the following fact. On attracting the recording paper, the top end side of the recording paper P is in the same direction as the direction of the rotation of the transfer drum as seen from the central portion of the recording paper P. Accordingly, if the electrostatic attraction force on the top end side is weak, there is a possibility that the recording paper P is peeled off from the transfer drum due to the rotation of the transfer drum, resulting in the occurrence of jam. However, the rear end side of the recording paper P is in the opposite direction to the direction of the rotation as seen from the central portion of the recording paper P. Accordingly, even if the electrostatic attraction force is somewhat weak, the recording paper P will not be peeled off from the transfer drum due to the rotation of the transfer drum. Therefore, only the diameter of cell of the portion attracting the top end portion of the recording paper P in the foamed rubber 31*b* and 42 is set to be larger than that of the residual portion. Thus, the electrostatic attraction force of the portion attracting the top end portion is made stronger than that of the residual portion, which ensures the prevention of peeling off of the recording paper P with reliability. Also, the foamed rubber 31*b* of the fourth and fifth embodiments may be other foamed materials excluding the foamed rubber 31*b*, for example, a foamed material capable of forming the first and second semiconductor layers 22 and 23. Further, it may be formed by members other than foamed materials as long as they can form the gap 32.

Also, based on the same reason as in the fourth and fifth embodiments, in the first to third embodiments, it is most preferable that the non-transfer region NP of the transfer drum 5, 5A, or 5B is set at the portion attracting the top end portion and rear end portion of the recording paper P in the recording paper carrying portion X. In the first to third embodiments, in the case where the color image forming apparatuses can use sheets of the recording paper with a variety of sizes, it is preferable that the portion attracting the top end portion of the recording paper P in the recording paper carrying portion X is taken as the non-transfer region NP. Consequently, the recording paper P can be prevented from peeling off from the transfer drum 5, 5A, or 5B with reliability.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A transfer apparatus for transferring a toner image from a surface of an image carrier to a transfer material, the transfer apparatus comprising:

a carrying member frame;

a semiconductor layer stacked on the surface of the carrying member frame; and a dielectric layer covering the semiconductor layer, wherein the semiconductor layer is formed from a foamed material so that a diameter of cell of a portion of the foamed material in a predetermined toner image non-transfer region is set to be larger than a diameter of cell of the foamed material in a predetermined toner image transfer region.

2. The transfer apparatus of claim 1, wherein the diameter of cell of the portion of the foamed material under the non-transfer region is 100 $\mu$m or more, while the diameter of cell of the portion of the foamed material under the transfer region is more than 0 $\mu$m and less than 100 $\mu$m.

3. The transfer apparatus of claim 1, wherein the diameter of cell of the portion of the foamed material under the non-transfer region is 500 $\mu$m or more, while the diameter of cell of the portion of the foamed material under the transfer region is in a range of over 0 $\mu$m to 50 $\mu$m.

4. The transfer apparatus of claim 1 wherein the non-transfer region includes a portion for attracting a top end portion of the transfer material in a carrying portion.

5. The transfer apparatus of claim 4, wherein the non-transfer region further includes a portion for attracting one side end portion of the transfer material serving as a standard for registration of the transfer material with respect to the carrying member frame, in the carrying portion.

6. The transfer apparatus according to claim 1, wherein the dielectric layer is formed from a polymer film comprising polyvinylidene fluoride.

7. The transfer apparatus according to claim 1 wherein the semiconductor layer has a resistivity of about $10^9$ Ωcm±1 digit.

8. The transfer apparatus according to claim 1, wherein the portion of the foamed material having the larger diameter of cell comprises ethylene-propylene-diene-monomer of a carbon dispersing type.

9. The transfer apparatus according to claim 1, wherein the portion of the foamed material in the predetermined toner image transfer region comprises ionically conductive hydrin rubber.

10. A transfer apparatus for transferring a toner image from a surface of an image carrier to a transfer material, the transfer apparatus comprising:

a carrying member frame;

a semiconductor layer stacked on the surface of the carrying member frame;

a dielectric layer covering the semiconductor layer; and at least one gap portion formed between the semiconductor layer and the dielectric layer, wherein a size of the gap portion under a predetermined toner image non-transfer region is larger than a size of the gap portion under a predetermined toner image transfer region.

11. The transfer apparatus of claim 10, wherein the size of the gap portion under the non-transfer region is larger than 500 $\mu$m, while the size of the gap portion under the transfer region is in a range of over 0 $\mu$m to 500 $\mu$m.

12. The transfer apparatus of claim 10, wherein the portions of the semiconductor layer under the non-transfer region and under the transfer region, respectively, are formed by mutually different members.

13. The transfer apparatus of claim 10, the transfer apparatus further comprising a gap forming member for forming a large gap portion in the non-transfer region, the gap forming member being interposed between the portion of the semiconductor layer under the non-transfer region and the dielectric layer, wherein a size of the gap portion formed by a foamed material forming the semiconductor layer is uniform in the state where the gap forming member is not interposed.

14. The transfer apparatus of claim 10, wherein the non-transfer region includes a portion for attracting a top end portion of the transfer material in a carrying portion.

15. The transfer apparatus according to claim 10, wherein the dielectric layer is formed from a polymer film comprising polyvinylidene fluoride.

16. The transfer apparatus according to claim 10, wherein the semiconductor layer has a resistivity of about $10^9$ Ωcm±1 digit.

* * * * *